US005115971A

United States Patent [19]

Greenspan et al.

[11] Patent Number: 5,115,971

[45] Date of Patent: May 26, 1992

[54] NEBULIZER DEVICE

[75] Inventors: Bernard J. Greenspan, Richland; Owen R. Moss, Kennewick, both of Wash.

[73] Assignee: Battelle Memorial Institute, Richmond, Wash.

[21] Appl. No.: 248,558

[22] Filed: Sep. 23, 1988

[51] Int. Cl.[5] ..... B05B 5/025

[52] U.S. Cl. ..... 239/3; 239/690; 361/228

[58] Field of Search ..... 239/102.1, 102.2, 690, 239/690.1, 3; 310/339; 361/228, 235

[56] References Cited

U.S. PATENT DOCUMENTS

| | | | |
|---|---|---|---|
| 705,691 | 7/1902 | Morton | 239/690 |
| 3,114,654 | 12/1963 | Nishiyama et al. | 239/102.2 |
| 3,262,019 | 7/1966 | Maltner et al. | 310/339 |
| 3,558,903 | 1/1971 | Yamano | 310/339 |
| 3,579,245 | 5/1971 | Berry | 239/3 |
| 3,802,625 | 4/1974 | Buser et al. | 239/704 |
| 3,930,614 | 1/1976 | Krenkel | 239/695 |
| 3,997,817 | 12/1976 | Secker | 310/339 |
| 4,106,697 | 8/1978 | Sickles et al. | 239/705 |
| 4,113,809 | 9/1978 | Abair et al. | 261/81 |
| 4,334,531 | 6/1982 | Reichl et al. | 128/200.14 |
| 4,341,347 | 7/1982 | DeVittorio | 239/3 |
| 4,356,528 | 10/1982 | Coffee | 361/226 |
| 4,381,533 | 4/1983 | Coffee | 361/228 |
| 4,476,515 | 10/1984 | Coffee | 361/226 |
| 4,545,525 | 10/1985 | Sachar et al. | 239/3 |
| 4,549,243 | 10/1985 | Owen et al. | 361/228 |
| 4,561,037 | 12/1985 | MacLaine et al. | 361/228 |
| 4,630,169 | 12/1986 | Kelly | 239/690 |
| 4,634,057 | 1/1987 | Coffee et al. | 239/690 |
| 4,663,639 | 5/1987 | Owen et al. | 346/140 |
| 4,702,418 | 10/1987 | Carter et al. | 239/101 |
| 4,749,125 | 6/1988 | Escallon et al. | 239/3 |
| 4,776,515 | 10/1988 | Michalchik | 239/3 |
| 4,788,016 | 11/1988 | Colclough et al. | 239/3 |
| 4,795,330 | 1/1989 | Noakes et al. | 425/6 |
| 4,829,996 | 5/1989 | Noakes et al. | 128/200 |

FOREIGN PATENT DOCUMENTS

| | | |
|---|---|---|
| 0224352 | 6/1987 | European Pat. Off. . |
| 2128900 | 5/1989 | United Kingdom . |

OTHER PUBLICATIONS

"Production of Monodisperse Liquid Particles by Electrical Atomization", B. Vonnegut & R. L. Neubauer, J. Colloidal Sci., vol. 7 (1952) 616-622.

"The Electrical Dispersion of Liquids as Aerosols", Vadim Drozin, J., Colloidal Sci., vol. 10 (1955) 158-164.

"Electrical Dispersion of Liquids from Capillary Tips-A Review", R. Bollini & S. Sample, Colloidal & Interface Sci., vol. 3 Academic Press Inc. (1976) 291-299.

"Aerosol Technology", William C. Hinds, John Wiley & Sons 379-382.

"Aerosol Technology in Hazard Evaluation", Thomas T. Mercer, Academic Press (1973) 336-346.

"Solid Homogeneous Aerosol Production by Electrical Atomization", E. Yurkstas & C. Meisenzehl, Univ. Of Rochester Atomic Energy Project (1964).

*Primary Examiner*—Andres Kashnikow
*Assistant Examiner*—Christopher G. Trainor
*Attorney, Agent, or Firm*—Dellett, Smith-Hill and Bedell

[57] ABSTRACT

The present invention constitutes a portable neubulizer capable of producing a finely divided aerosol having uniformly sized droplets. The nebulizer includes a source of fluid such as a capillary tube coupled to a fluid reservoir to which a high voltage is applied in order to generate the aerosol by electrical atomization. The nebulizer further includes a piezoelectric crystal and a mechanism for deforming the crystal so as to generate the required voltage. By using electrical atomization to generate the aerosol and by piezoelectrically generating the voltage required for atomization, a nebulizer is provided which may be of small size so as to be suitable for hand held operations yet is capable of producing measured amounts of finely divided aerosols which are substantially monodispersed.

3 Claims, 1 Drawing Sheet

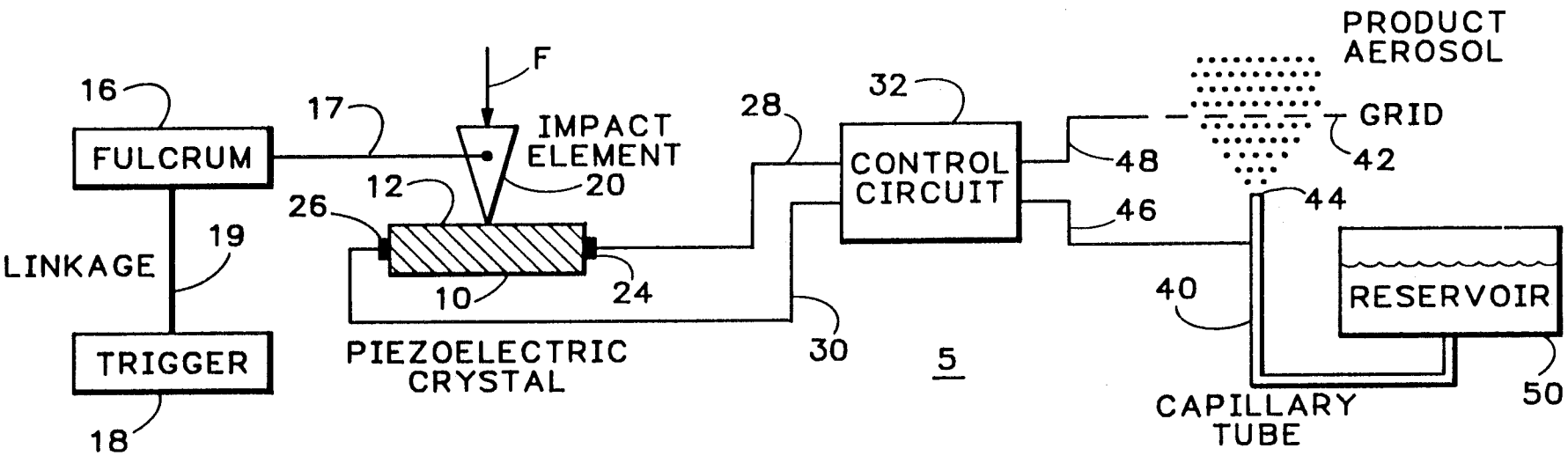
PRODUCT AEROSOL
GRID
42
44
RESERVOIR
50
CAPILLARY TUBE
40
48
46
CONTROL CIRCUIT
32
5
30
28
IMPACT ELEMENT
20
24
F
10
12
PIEZOELECTRIC CRYSTAL
17
26
FULCRUM
16
19
LINKAGE
TRIGGER
18

NEBULIZER DEVICE

BACKGROUND OF THE INVENTION

The present invention relates to devices for atomizing liquids and more particularly to devices for producing finely divided aerosols having uniformly sized droplets.

Finely divided aerosols have generally been produced by nebulizers employing compressed air to atomize fluids. These devices operate by allowing compressed air to escape from a small orifice at the end of a tube at high velocity The low pressure created in the exit region as a result of the bernoulli effect causes the fluid to be atomized to be drawn out of a second tube as a thin filament which is broken up into droplets of various small sizes as it is accelerated in the airstream. This spray is then directed around an impaction surface on which the large droplets are preferentially deposited and whereby some uniformity is provided with respect to droplet size. However, most nebulizers operating with compressed air have difficulty producing aerosols having particle sizes approaching one micron and cannot ordinarily generate aerosols which are sufficiently uniform in size so as to be "monodispersed".

Finely divided aerosols are highly useful in many applications and particularly in administering medications which are pneumonically delivered to the patient by inhalation. Most "inhalators" used in dispensing medications are compressed air nebulizers of sufficiently small size to be suitable for hand-held use. However, in view of the characteristic limitations of such nebulizers and the further limitations inherent in the small size of most inhalators, users of these devices have had great difficulty in providing aerosols having uniform particle size and in the related problem of providing consistent measured amounts of medication.

It is therefore an object of the present invention to provide a portable nebulizer capable of generating finely divided aerosols which are substantially monodispersed.

It is another object of the present invention to provide a nebulizer which may be small enough for handheld use and yet provides aerosols of substantially uniform particle size while being capable of supplying medication in consistently measured dosages.

It is a further object of the present invention to provide a nebulizer which may be powered by the hand gripping pressure of a user of the device and which is sufficiently economical to construct so as to be disposible.

SUMMARY OF THE INVENTION

The present invention comprises a portable handheld nebulizer capable of generating aerosols characterized by uniformly-sized droplets of very small dimensions by electrical atomization. A piezoelectric crystal is constructed and arranged for being mechanically deformed in accordance with pressure applied to a trigger mechanism. The crystal is adapted for generating high voltages in response to such deformations. The crystal is electrically coupled to a capillary tube and a grid element which is spaced apart from the tip of the tube. The capillary tube is connected to a reservoir of fluid to be atomized so as to allow the fluid to be supplied up to the tip of the tube. The preferred embodiment of the present invention also includes a control circuit which regulates the output of this piezoelectric crystal in order to cut off the output below and above prescribed voltage limits.

In operation, the deformation of the piezoelectric crystal produces a high voltage which is transmitted to and applied across the capillary tube and grid element. The electric field existing between the tip of the tube and the grid encourages the discharge of fluid from the tube. This fluid is broken into a very large number of similarly sized droplets by the effects of the electric charges carried by the fluid and a "fan spray" aerosol is thereby formed. This process of electrical atomization furnishes an aerosol consisting of large numbers of very fine particles having a high degree of uniformity. Such aerosols are highly useful in pneumonically administering medications and in many other applications.

The subject matter of the present invention is particularly pointed out and distinctly claimed in the concluding portion of this specification. However, both the organization and method of operation, together with further advantages and objects thereof, may best be understood by reference to the following description taken in connection with the accompanying drawing wherein like reference characters refer to like elements.

BRIEF DESCRIPTION OF THE DRAWING

The drawing is a diagrammatic view illustrating the overall system of the present invention.

DESCRIPTION OF THE PREFERRED EMBODIMENT

Referring now to the drawing, the present invention comprises a nebulizer device 5 including a piezoelectric ceramic crystal 10 of a conventional type such as a lead titanate-zirconate crystal. An impact element 20 is positioned for engaging the surface 12 of the crystal 10 so that force F exerted on the element 20 can bend and deform the crystal 10. The electrical contacts 24 and 26 are attached to opposite faces on the longitudinal ends of the crystal 10 for picking up electrical potentials generated across the crystal 10 by the deformation previously referred to. The conductive leads 28 and 30 transmit the voltage from the contacts 24 and 26 to the control circuit 32.

The impact element 20 is connected by a mechanical linkage to a trigger mechanism 18 which may be conveniently depressed by hand gripping pressure exerted by a user of the device 5. The force applied by the user to the trigger mechanism 18 is multiplied by the mechanical linkage and brought to bear on the crystal 10 by the impact element 20. The linkage suitably comprises a rigid lever arm with its fulcrum at 16 positioned more closely to element 20 than to trigger 18 (i.e. with arm 17 being substantially shorter than arm 19). Alternatively, the mechanical linkage may comprise a rack and pinion system with the impact element 20 being driven by a cam from the pinion. Such means for multiplying force are readily understood by those skilled in the art.

The control circuit 32 is operative for regulating the voltage generated by the piezoelectric crystal 10 so that the electrical potential applied between the capillary tube 40 and neutralization grid 42 over the electrically conductive leads 46 and 48 is maintained within the range of 6–10 Kv. In particular, the voltage is preferably not applied between the tube 40 and grid 42 when it is less than about 6 Kv since this may detrimentally effect the uniformity of the aerosol. The control circuit 32 also provides a capacitive or storing function for storing and releasing electrical charge in a well known manner so that the voltage supplied to tube 40 and grid 42 may be sustained beyond the actual period of depression of the trigger mechanism 18. The leads 46 and 48 transmit the electrical potential from the control circuit 32 to the tube 40 and grid 42, respectively, with the positive potential being applied to the tube 40 (and/or the fluid within the tube 40).

The reservoir 50 contains a fluid (and more particularly a liquid) capable of being dispersed by electrical atomization techniques, such as water or ethyl alcohol, and is hydraulically connected to the capillary tube 40 so that the fluid from the reservoir 50 can flow up to the tip 44 of the tube 40. The inside diameter of the capillary tube 40 is preferably in the range of 100–500 microns with its outside dimensions being as thin as possible consistent with maintaining sufficient strength and rigidity. The capillary tube 40 preferably comprises a stainless steel tube such as a No. 25 hypodermic needle although the tube 40 may be constructed of glass or of a plastic such as tetrafluoroethylene. The fluid level in reservoir 50 should be high enough to allow the fluid to reach the tip of tube 40 by fluid flow or capillary action. Neutralization grid 42 is spaced apart by approximately 1.5 cm from the tip 44 of the capillary tube 40.

In operation, the user slowly presses the trigger mechanism 18 which results in the crystal 10 being progressively deformed as more and more force is applied to the crystal 10 by impact element 20. The piezoelectric crystal 10 generates a voltage which may ordinarily range upward to 20 Kv and may be sustained in the range of 6–10 Kv for a period of several seconds. The exact levels of voltage generated are a function of the force applied to the trigger, and the characteristics of the mechanical linkage 16, impact element 20, and the piezoelectric crystal 10 itself. These components may be adjusted to assist in achieving the desired raw voltage output to the control circuit 32.

As previously described, the control circuit desirably regulates the output of the crystal 10 so as to limit it within the range of 6–10 Kv and "lengthen" the period of time during which voltage is provided. The voltage provided by the control circuit 32 is applied between the capillary tube 40 and the neutralization grid 42. The resultant electric field existing between the pointed projection formed by the tip 44 of the tube 40 and grid 42 causes the generation of a fan spray aerosol composed of substantially monodispersed droplets capable of exhibiting higher order Tyndall spectra. Droplets with sizes in the range of 0.2 to 5 microns can be readily produced with droplet concentration levels approaching $10^8$ particles per cubic centimeter.

The ability of the device 5 to produce a satisfactory aerosol can, however, be dependent on the type of fluid which is desired to be dispersed. Fluids having either very low (e.g. benzene) or high (e.g. inorganic acids, salts) conductivities are difficult to disperse by electrical atomization. Furthermore, other characteristics of fluids such as their dielectric constants, dipole moments and surface tensions may affect their ability to be electrically atomized. Consequently, when medications which are dissolved in solution are desired to be dispersed, appropriate vehicles should be chosen for solvating such medications for allowing efficient atomization.

The nature of the aerosol produced by the device 5 is a complex function of the applied voltage, the size and structure of the capillary tube 40, the spacing between the tube 40 and the grid 42, the hydrostatic pressure of liquid at the tip 44 of the tube 40, and the characteristics of the liquid as previously discussed. These factors may be adjusted either individually or in combination to achieve the aerosol particle size and volume desired. In particular, the control circuit 32 is suitably used to insure that voltage applied between the tube and grid is of consistent level and duration for aerosol generation, thereby resulting in measured dosages of medical products atomized by the device 5.

While a preferred embodiment of the present invention has been shown and described, it will be apparent to those skilled in the art that many changes and modifications may be made without departing from the invention in its broader aspects. For example, more than one capillary tube may be employed in the same nebulizer device so as to increase the volume of the aerosol produced as compared with a single tube nebulizer device. By way of further example, the capillary tube may, under suitable conditions, be replaced by another type of pointed projection such as a short needle constructed and arranged so as to allow the liquid to be atomized as otherwise supplied to its tip. The appended claims are therefore intended to cover such changes and modifications as fall within the true spirit and scope of the invention.

We claim:

1. A method of administering a medication in aerosol form, said method comprising:

dispensing a medicinal fluid;

generating an electrical potential by exerting pressure on a piezoelectric member;

electrically attracting said fluid with said potential, including regulating the value of said potential as applied to attract said fluid to provide a monodispersed fan spray; and directing said spray for medicinal application;

including automatically regulating the duration as well as the value of said potential as applied to attract said fluid to provide a predetermined dose of aid medication.

2. A method of administering a medication in aerosol form, said method comprising:

dispensing a medicinal fluid from a small capillary;

generating a high voltage by exerting pressure on a piezoelectric member;

electrically attracting said fluid outwardly from said capillary by applying said high voltage, as said high voltage exceeds a predetermined value, to said capillary with respect to a point of reference potential to form a fan spray of small particle size; and directing said spray for medicinal application;

including automatically regulating the duration of application of said high voltage to said capillary to provide a predetermined dose of medication.

3. A nebulizer which is adapted for producing finely divided aerosols having uniformly sized droplets yet which is manually powered by hand gripping pressure, said nebulizer comprising:

a piezoelectric crystal;

means for manually deforming said crystal so as to generate a high voltage;

a projection constructed and arranged for being supplied with a flow of liquid to be atomized;

means for applying voltage generated by said crystal to said projection; and means for regulating the value of the voltage as applied to said projection as well as for automatically controlling the duration of said application of said voltage in order to provide a predetermined dose of said liquid.

* * * * *

UNITED STATES PATENT AND TRADEMARK OFFICE

CERTIFICATE OF CORRECTION

PATENT NO. : 5,115,971

DATED : May 26, 1992

INVENTOR(S) : Bernard J. Greenspan; Owen R. Moss

It is certified that error appears in the above-identified patent and that said Letters Patent is hereby corrected as shown below:

Column 1, line 13, "velocity The" should be --velocity. The--.

Column 1, line 54, "handheld" should be --hand-held--.

Column 4, line 38 (claim 1), "of aid medication" should read --of said medication--.

Column 4, line 52 (claim 2), "of medication" should read --of said medication--.

Signed and Sealed this

Fourteenth Day of December, 1993

Bruce Lehman

*Attest:*

BRUCE LEHMAN

*Attesting Officer*

*Commissioner of Patents and Trademarks*